US008296898B1

(12) United States Patent
Moncrief

(10) Patent No.: US 8,296,898 B1
(45) Date of Patent: Oct. 30, 2012

(54) CLEANING ELECTRICAL CONNECTIONS

(75) Inventor: Christopher Lee Moncrief, Overland Park, KS (US)

(73) Assignee: Sprint Communications Company L.P., Overland Park, KS (US)

( * ) Notice: Subject to any disclaimer, the term of this patent is extended or adjusted under 35 U.S.C. 154(b) by 242 days.

(21) Appl. No.: 12/703,318

(22) Filed: Feb. 10, 2010

(51) Int. Cl.
*A47L 7/00* (2006.01)

(52) U.S. Cl. ..... 15/322; 15/301; 15/415.1; 15/416; 15/302; 15/304; 222/595; 451/38; 134/198

(58) Field of Classification Search ..... 15/301, 15/321, 322, 415.1, 416, 304, 302; 433/88, 433/216; 222/595; 451/38; 134/103.2, 198
See application file for complete search history.

(56) References Cited

U.S. PATENT DOCUMENTS

| | | | | |
|---|---|---|---|---|
| 4,733,678 | A | 3/1988 | Bolois | |
| 5,172,450 | A | 12/1992 | Cole | |
| 5,711,822 | A | 1/1998 | Burgett | |
| 6,039,490 | A | 3/2000 | Banks et al. | |
| 6,536,379 | B1 * | 3/2003 | Liu | 122/379 |
| 7,131,838 | B2 | 11/2006 | Suzuki | |

* cited by examiner

*Primary Examiner* — William Gilbert
*Assistant Examiner* — Chi Q Nguyen

(57) ABSTRACT

A device for cleaning inside electrical-connection sockets, methods for constructing such cleaning devices, and methods for using such cleaning devices are illustrated herein. The device may be shaped like an electrical plug designed for coupling with the electrical-connection socket. The device includes a primary fluid-duct, ejection ducts, and ejection ports for allowing fluid to be injected into the chamber. A cleaning fluid is pushed through the device into the chamber. Air can then be pushed into the chamber.

18 Claims, 4 Drawing Sheets

CLEANING ELECTRICAL CONNECTIONS

SUMMARY

Embodiments of the invention are defined by the claims below, not this summary. A high-level overview of embodiments of the invention is provided here for that reason, to provide an overview of the disclosure. This summary is not intended to identify key features or essential features of the claimed subject matter, nor is it intended to be used as an aid in isolation to determine the scope of the claimed subject matter.

A first aspect of the invention includes a device for cleaning a chamber of an electrical-connection socket. In embodiments, the device includes a plug body that can be inserted into the chamber of the electrical-connection socket. Upon being inserted into the chamber, the plug body opens a switch, thereby allowing for injection of a cleaning fluid into the open switch. Embodiments of the device further include a primary fluid-duct that extends through a portion of the plug body and an ejection port. According to various embodiments of the invention, the ejection port is connected to a first end of an ejection duct. According to embodiments of the invention, the ejection duct extends into the plug body and is connected, at a second end, to the primary fluid-duct.

In a second aspect, embodiments of the invention include a device for cleaning a chamber of an electrical-connection socket. According to various embodiments, the chamber is designed to receive an electrical plug that engages a number of electrical contacts within the chamber, thereby completing an electrical circuit. Illustrative embodiments of the device include a plug body that can be inserted into the chamber of the electrical-connection socket. The plug body has a profile that is similar to a profile of the electrical plug that is designed to couple with the socket. According to embodiments of the invention, the device includes a primary fluid-duct that extends through a portion of the plug body and a fluid-injection mechanism that causes a predetermined portion of cleaning fluid to enter the primary fluid-duct. The device can also include a number of ejection ducts. In embodiments, each ejection duct is connected, at a first end, to the primary fluid-duct and extends away from the primary fluid-duct. Each ejection duct terminates, at a second end, in an ejection port disposed on an outside surface of the plug body.

In another aspect, embodiments of the invention include a device for cleaning a chamber of an electrical-connection socket. According to various embodiments, the device includes means for opening a switch inside the electrical-connection socket. The switch includes a normally-closed contact having a tab that extends into the chamber. In embodiments, the device also includes means for causing a predetermined amount of cleaning fluid to be ejected from each of a number of ejection ports into the chamber. According to embodiments, each of the ejection ports is disposed in an external surface of a plug body and is connected to an ejection duct that extends between the external surface of the plug body and a primary fluid-duct disposed within the plug body.

BRIEF DESCRIPTION OF THE SEVERAL VIEWS OF THE DRAWINGS

Illustrative embodiments of the present invention are described in detail below with reference to the attached drawing figures, which are incorporated by reference herein and wherein.

DETAILED DESCRIPTION

Embodiments of the present invention provide devices for cleaning chambers of electrical-connection sockets, method for constructing the devices, and methods for using the devices.

The subject matter of the present invention is described with specificity herein to meet statutory requirements. However, the description itself is not intended to limit the scope of this disclosure to only the embodiments described herein. Rather, the inventors have contemplated that the claimed subject matter might also be embodied in other ways, to include different structural features, steps or combinations of structural features and/or steps similar to the ones described in this document, in conjunction with other technologies.

Figure 1:
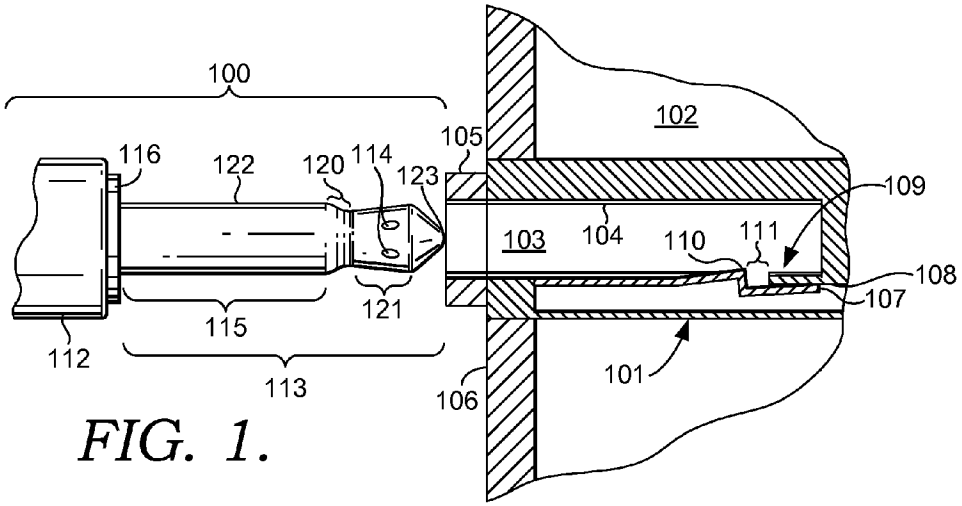
FIG. 1 depicts a cut-away side view of an electrical-connection socket and a device for cleaning a chamber of the socket in accordance with embodiments of the present invention.

Turning now to the drawings, FIG. 1 depicts a side view of a cleaning device 100 and an electrical-connection socket 101. The socket is disposed within an electronic device 102 and, according to embodiments of the invention, is designed to receive an electrical plug (not shown). The electronic device 102 can be any type of electronic device, such as a computer, electronic gaming unit, personal digital assistant, cellular phone, amplifier, or media player (e.g., MP3 player, CD player, etc.). In normal operation, when an electrical plug is inserted into the socket 101, the electrical plug engages one or more electrical contacts within the chamber, thereby completing an electrical circuit.

The socket 101 can be any type of electrical-connection socket suitable for receiving an electrical plug such as, for example, a double-contact plug (e.g., a TS connector), a triple-contact plug (e.g., a TRS connector), a quadruple-contact plug (e.g., a TRRS connector), a two-pin 310 connector, and the like. Accordingly, in embodiments, the socket 101 can include any number of electrical contacts. For example, in one embodiment, the socket 101 includes only one electrical contact, whereas in other embodiments, the socket 101 includes two, three, four, or more electrical contacts. The socket 101 can be additionally defined and/or identified by the size of electrical plug that it is designed to receive. For example, the socket 101 might be referred to as a 2.5 mm jack, a 3.5 mm jack, a 6.35 mm jack, or the like. Examples of such sockets (i.e., jacks) can be utilized for a number of purposes and can be embodied as headset jacks, microphone jacks, patch-cord sockets, output connectors for video-recording devices, DC power connectors, and the like. Exemplary electrical devices in which the socket 101 can be found include mobile devices (e.g., cellular phones, personal digital assistants (PDAs), etc.), portable media players, personal computers, laptop computers, patchbays, electrical instruments (e.g., guitars, keyboards, etc.), audio components (e.g., amplifiers, media players, effects processors, etc.), and the like.

As illustrated in FIG. 1, the socket 101 includes a chamber 103 (e.g., a void) defined by a surrounding chamber-wall 104. In some embodiments, the chamber 103 is cylindrical in shape, whereas in other embodiments, the chamber 103 can have any other shape. For example, in some embodiments, the chamber 103 can have a square or rectangular cross-sectional profile, a triangular cross-sectional profile, or the like. In embodiments, the socket 101 further includes a plug stop 105 disposed on an outer surface 106 of the socket 101. In some embodiments, the plug-stop 105 is flush with an external surface 106 of the electronic device 102. In other embodiments, the plug-stop 105 can extend beyond the external surface 106 of the electronic device 102.

With continued reference to FIG. 1, the socket 101 includes at least one normally-closed (NC) contact 107, 108 that defines a switch 109. The switch 109 includes a moveable contact 107 that engages a stationary contact 108. In embodiments, the moveable contact 107 further includes a tab 110 that extends into the chamber 103 such that when an electrical plug is inserted into the chamber 103, the electrical plug engages the tab 110, thereby applying a force to the moveable contact 107. The applied force causes the moveable contact 107 to move away from the stationary contact 108, thereby opening the switch 109.

As a result of normal use, contaminants can be deposited throughout the chamber 103 of the socket 101. Additionally, contaminants can be deposited in a gap 111 defined between a portion of the moveable contact 107 and the stationary contact 108, causing decreased electrical performance. For this reason, the cleaning device 100 is equipped with means for opening the switch 109, thereby allowing cleaning fluid to remove contaminants from the gap 111 inside the switch 109. To provide cleaning fluid to the inside of the chamber 103, the cleaning device 100 includes means for opening a switch 109 inside the electrical-connection socket 101, a fluid-injection mechanism 112 that forces cleaning fluid through a portion of the plug body 113, and means for causing a predetermined amount of cleaning fluid to be ejected from each of a plurality of ejection ports 114 into the chamber 103.

According to embodiments of the invention, the means for opening the switch 109 inside the electrical-connection socket 101 include a plug body 113 that is designed such that, when the plug body 113 is inserted into the chamber 103 of the socket 101, the plug body 113 opens the switch 109. In an embodiment, for example, the plug body 113 is roughly the same shape as an electrical plug that is designed to be inserted into the socket 101. In this manner, the plug body 113 mimics the electrical plug when it is inserted into the socket 101, thereby opening switches 109 that the electrical plug is designed to open upon being inserted into the socket 101.

According to various embodiments of the invention, the plug body 113 includes a first portion 115 that is disposed, at a first end, adjacent to a fluid-injection mechanism 112. In some embodiments, the first portion 115 of the plug body 113 is coupled directly to the fluid-injection mechanism 112. In other embodiments, a plug base 116 is disposed between the fluid-injection mechanism 112 and the first end of the first portion 115. In some embodiments, the first portion 115 is generally cylindrical in shape. In other embodiments, the first portion 115 is square or rectangular in shape. In still further embodiments, the first portion 115 can have any shape that is suitable for engagement with the socket 101.

Figure 2:
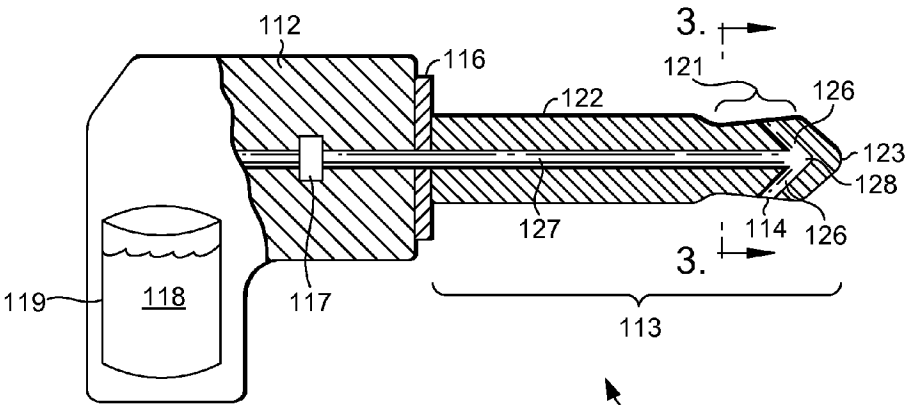
FIG. 2 depicts a partially cut-away side view of a device for cleaning a chamber of an electrical-connection socket in accordance with embodiments of the present invention.

According to various embodiments of the invention, the fluid-injection mechanism 112 can include any type of mechanism suitable for causing cleaning fluid to move through the plug body 113 and into the chamber 103. For example, the fluid-injection mechanism 112 can include a pump, a spray bottle, an aerosol can, a collapsible chamber (e.g., a squeeze-bulb), a piston (e.g., a syringe), a gravity-device, or the like. In some embodiments, as illustrated in FIG. 2, the fluid-injection mechanism 112 includes a flow regulator 117 that allows for a predetermined amount or rate-of-flow of fluid 118 to pass into the plug body 113. In other embodiments, the fluid-injection mechanism 112 can be designed such that the injection operation itself only operates on a predetermined amount or rate-of-flow of fluid 118. Additionally, in embodiments, the fluid-injection mechanism 112 includes a fluid reservoir 119 that holds some amount of cleaning fluid 118. In that case, cleaning fluid 118 is extracted from the fluid reservoir 119 and moved into the plug body 113.

With continued reference to FIGS. 1 and 2, the plug body 113 further includes a narrowing portion 120 and a widening portion 121, which resemble similar features of typical electrical-connection plugs. The narrowing portion 120, which in embodiments is disposed adjacent to the first portion 115, is defined by a tapering of the outer surface 122 of the plug body 113 inward. In an embodiment, the inward taper begins at a second end of the first portion 115 and tapers inward toward the tip 123 of the plug body 113. The widening portion 121 is adjacent to the narrowest end of the narrowing portion 120 and is defined by a tapering of the outer-surface 122 of the plug body 113 outward toward the tip 123. The narrowing portion 120 and the widening portion 121 are designed to mimic the commonly-known shape of electrical plugs designed to engage the socket 101.

Figure 4:
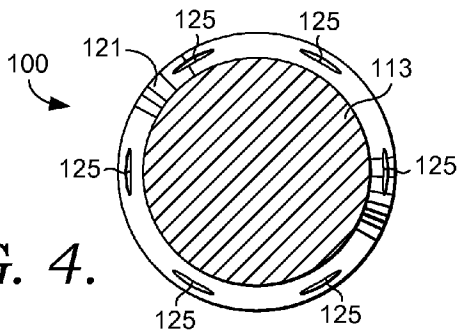
FIG. 4 depicts another rear view of a plug body in accordance with embodiments of the present invention.
Figure 3:
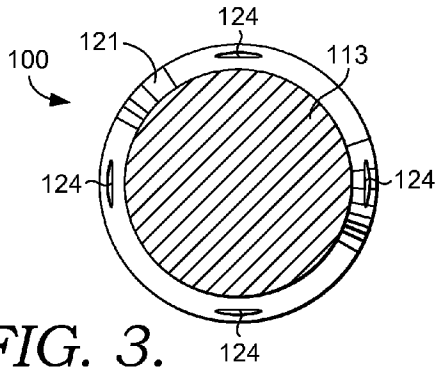
FIG. 3 depicts a rear view of a plug body in accordance with embodiments of the present invention.

As indicated above, the cleaning device 100 includes means for causing a predetermined amount of cleaning fluid 118 to be ejected from each of a plurality of ejection ports 114 into the chamber 103. As illustrated in FIGS. 1 and 2, a number of ejection ports 114 are disposed in the surface of the widening-portion 121 of the plug body 113. According to embodiments of the invention, the device 100 can contain any number of ejection ports 114. For example, in one embodiment, illustrated in FIG. 3, the device 100 includes four ejection ports 124 and, in another embodiment, as illustrated in FIG. 4, the device includes six ejection ports 125. In further embodiments, the device 100 may contain some other number of ejection ports. According to various embodiments, and with reference again to FIGS. 1 and 2, the ejection ports 114 are evenly spaced around the diameter of the widening-portion 121 of the plug body 113.

According to various embodiments of the invention, the means for causing a predetermined amount of cleaning fluid 118 to be ejected from each of a plurality of ejection ports 114 into the chamber includes a number of ejection ducts 126. Each ejection duct 126 extends between an ejection port 114 on the external surface 122 of the plug body 113 through the plug body 113 to a primary fluid-duct 127 disposed within the plug body 113. With particular reference to FIG. 2, the primary fluid-duct 127 extends from the fluid-injection mechanism 112 through a portion of the plug body 113 and terminates at a junction 128 within the plug body 113. In embodiments, the ejection ducts 126 are connected to the primary fluid-duct 127 at the junction 128 and extend away from the junction 128 toward the surface 122 of the plug body 113. Accordingly, when cleaning fluid 118 is pushed through the primary fluid-duct 127, it is forced into the ejection ducts 126 upon reaching the junction 128.

Because contaminants that have been deposited within the chamber 103 of the socket 101 may stick to the internal surfaces of the chamber 103, the cleaning device 100 includes means for causing cleaning fluid 118 to be ejected from the ejection ports 114 with an amount of force that is sufficient to dislodge contaminants. In this manner, embodiments of the device 100 can be used without having to use brushes or other mechanically-abrasive cleaning techniques to remove contaminants. In some embodiments, the primary fluid-duct 127 is narrower near the junction 128 than near the fluid-injection mechanism 112. The narrowing of the primary fluid-duct 127 causes the pressure of the cleaning fluid 118 to increase as it travels toward the junction 128. In some embodiments, the ejection ducts 126 are narrower than the primary fluid-duct 127. In other embodiments, pressure is applied to the cleaning fluid 118 by the fluid-injection mechanism 112 such that the cleaning fluid 118 is ejected from the ejection ports 114 with the desired force.

Figure 5:
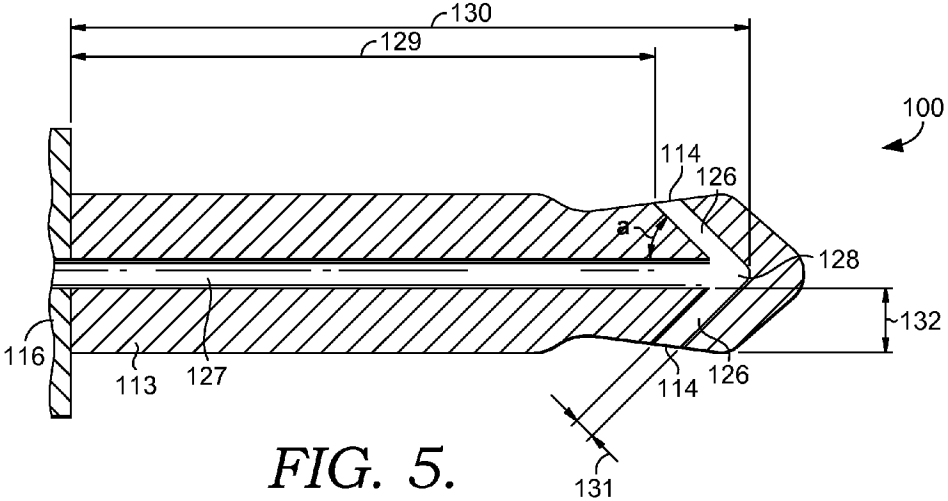
FIG. 5 depicts a cut-away view of a device for cleaning a chamber of an electrical-connection socket in accordance with embodiments of the present invention.

Turning now to FIG. 5, a cut-away view of the cleaning device 100 is illustrated. In an embodiment, as illustrated in FIG. 5, each ejection duct 126 connects to the primary fluid-duct 127 such that an angle a defined between the two ducts 126 and 127 is no greater than ninety degrees. This arrangement allows for directing the cleaning fluid 118 against the walls of the chamber 103. In one embodiment, for example, the angle defined between the two ducts 126 and 127 is forty-five degrees. In other embodiments, the angle defined between the two ducts 126 and 127 can be greater than ninety degrees. Moreover, in an embodiment, one of the ejection ports 114 is arranged such that, when the plug body 113 is inserted into the chamber 103 of a socket 101, the ejection port 114 aligns with an NC switch 109. By orienting the ejection ducts 114 at an angle with respect to the primary fluid-duct 127, ejected cleaning fluid 118 can be directed into the gap 111 defined by the contacts 107 and 108 of the switch 109, as illustrated in FIG. 1. In embodiments, the angle a can be ninety degrees. In other embodiments, the angle a is less than ninety degrees. For example, in one embodiment, the angle a is forty-five degrees.

With further reference to FIG. 5, the length of the primary fluid-duct 127 and the ejection ducts 126 can be selected to result in desired performance. For example, in one embodiment, the ejection ports 114 are positioned such that the distance 129 between the plug base 116 and each ejection duct 114 is no greater than 20 mm. In one embodiment, the length 130 of the primary fluid-duct 127 (as measured from the plug base 116) is 23.5 mm (for a device designed to clean a 3.5 mm socket) or 22.5 mm (for a device designed to clean a 2.5 mm socket). In embodiments, the ejection ducts 114 can have any desired diameter 131 such as, for example, 0.1 mm. Additionally, in some embodiments, the length of the ejection ducts 126 can be varied to achieve desired functionality. In an embodiment, the distance 132 from the ejection port 114 to the primary fluid-duct 127 (i.e., the depth at which each ejection duct 126 terminates) can be 3.5 mm or 2.5 mm, in a device for cleaning a 3.5 mm socket or a 2.5 mm socket, respectively.

Figure 6:
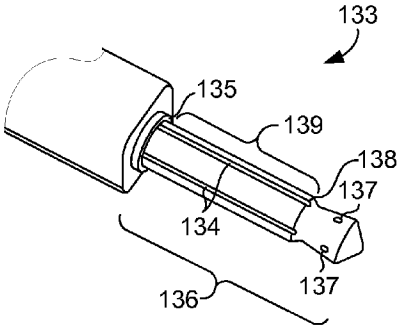
FIG. 6 depicts a perspective view of a device for cleaning a chamber of an electrical-connection socket in accordance with embodiments of the present invention.

Turning briefly to FIG. 6, an embodiment of a cleaning device 133 is illustrated that includes channels 134 that run from the plug base 135 along the surface of the plug body 136. In an embodiment, the channels 134 terminate at the ejection ports 137. In another embodiment, the channels 134 terminate at the second end 138 of the first portion 139 of the plug body 136. The channels 134 can be of any desired diameter and length. In an embodiment, for example, the each channel 134 extends 20 mm from the plug base 135 and has a width of 0.75 mm. It should be understood that any variations of these measurements may be employed to achieve desired results.

Figure 7:
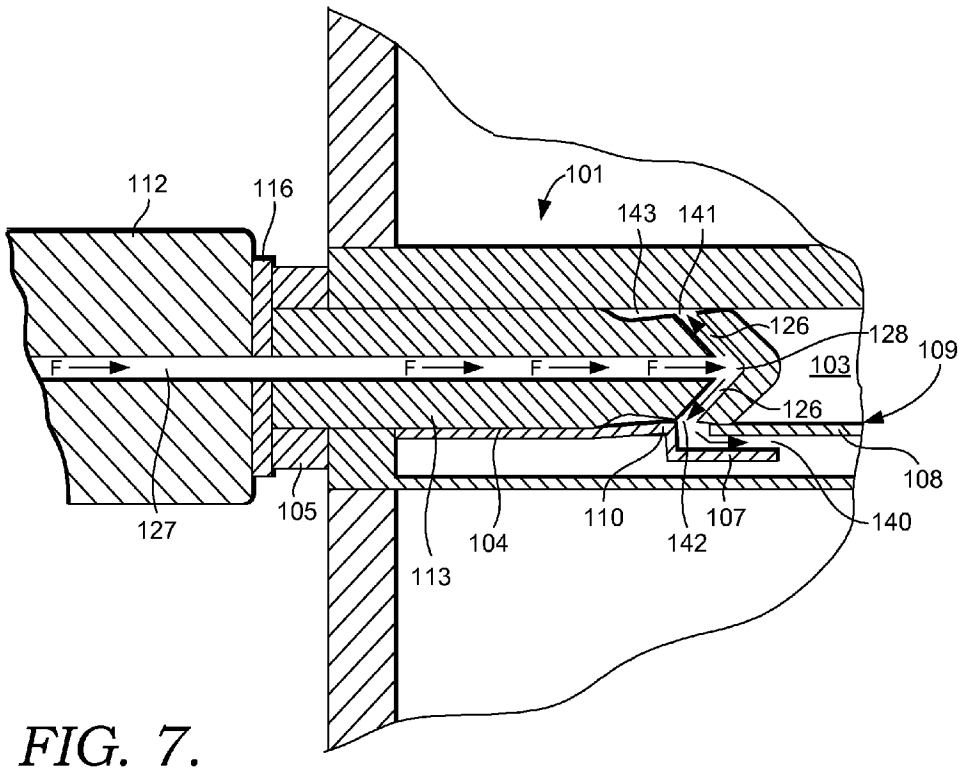
FIG. 7 depicts a cut-away view of an electrical-connection socket having a cleaning device inserted in a chamber of the electrical-connection socket in accordance with embodiments of the present invention.

Turning now to FIG. 7, a cut-away view of an electrical-connection socket 101 having a cleaning device 100 inserted in a chamber 103 of the electrical-connection socket 101 is illustrated in accordance with embodiments of the present invention. As illustrated in FIG. 7, when the plug body 113 is inserted into the chamber 103, the depth of insertion is limited by the plug stop 105, which engages a surface of the plug base 116. As further illustrated in FIG. 7, the plug body 113 engages the tab 110 of the moveable contact 107, thereby pushing the moveable contact 107 away from the stationary contact 108. In this manner, the plug body 113 causes the NC switch 109 to open, exposing a space 140 between the two contacts 107 and 108.

In operation, the fluid-injection mechanism 112 is activated and causes cleaning fluid F to flow into the primary fluid-duct 127. Upon reaching the junction 128, the cleaning fluid F is forced into ejection ducts 126 and then out of at least two ejection ports, labeled 141 and 142. Because the ejection port 141 is disposed on the widening portion of the plug body and faces in a partially rearward direction (as a result of the angle between the ejection duct 126 and the primary fluid-duct 127), the cleaning fluid F ejected from ejection port 141 is forced into gap 143, thereby removing contaminants from the chamber wall 104. As is further illustrated, the cleaning fluid F ejected from ejection port 142 is forced into gap 140 defined between the moveable contact 107 and the stationary contact 108 and out of the NC switch 109 via the space 140 created by opening the NC switch 109, thereby removing contaminants from inside the NC switch 109. After pushing cleaning fluid F through the plug body 113 and into the chamber 103, air can be pushed (or pulled) through the same ducts 126, 127 to remove excess fluid and contaminants that are leftover from the cleaning-fluid F application.

Figure 8:
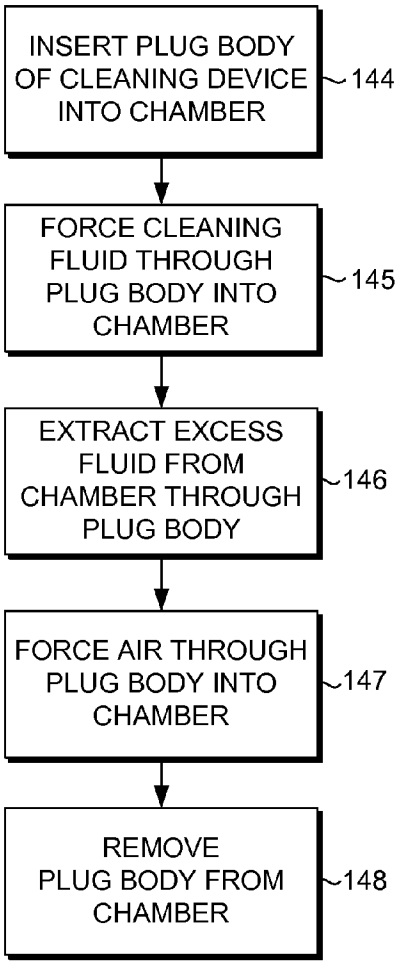
FIG. 8 is a flow chart depicting an illustrative method for cleaning a chamber of an electrical-connection socket in accordance with embodiments of the present invention.

To recapitulate, a cleaning device has been described that can be used to clean contaminants from a chamber of an electrical-connection socket disposed within an electrical device. Turning now to FIG. 8, an exemplary method of using embodiments of the device to a chamber of an electrical-connection socket is depicted in accordance with embodiments of the present invention. Although the term "step" is used herein to connote different components of methods employed, the term should not be interpreted as implying any particular order among or between various steps herein disclosed except when the order of individual steps is explicitly asserted. At a first illustrative step, step 144, a plug body of a cleaning device is inserted into the chamber of the electrical-connection socket. As described above, the plug body is similar in shape to an electrical plug designed for coupling with the socket. In embodiments, the electrical device can be manipulated such that the electrical-connection socket opens downward, thereby minimizing the amount of cleaning fluid that will flow into other parts of the electrical device. According to an embodiment, the device may first be taken apart or the electrical-connection socket may be otherwise removed from the device before cleaning.

At step 145, cleaning fluid is forced through the plug body and into the chamber of the socket. In embodiments, the cleaning fluid can include any type of standard electronics cleaner such as, for example, denatured alcohol. The cleaning fluid is forced through the plug body using a fluid-injection mechanism that can include a pump, a squeeze bulb, a piston, an aerosol spray-can, or the like. In some embodiments, the plug body is removed from the chamber after the fluid is forced through it, thereby allowing the user to, as shown at step 146, remove any excess fluid from the plug body. In embodiments, excess fluid can be removed by orienting the device vertically so that gravity pulls excess fluid out. In some embodiments, a suction mechanism such as, for example, a pump, a bulb, a syringe, or the like can be used to pull excess fluid from the chamber.

At step 147, air is forced through the plug body and into the chamber of the socket. If the plug body had been removed from the chamber after injecting the cleaning fluid, the plug body is reinserted into the chamber before performing this step. According to various embodiments, the air is forced through the plug body using an air-injection mechanism. In an embodiment, the air-injection mechanism is the fluid-injection mechanism. In other embodiments, the air-injection mechanism can be a different mechanism than that which was used to inject the cleaning fluid. At a final illustrative step 148, the plug body is removed from the chamber of the socket, and the cleaning process is complete.

Figure 9:
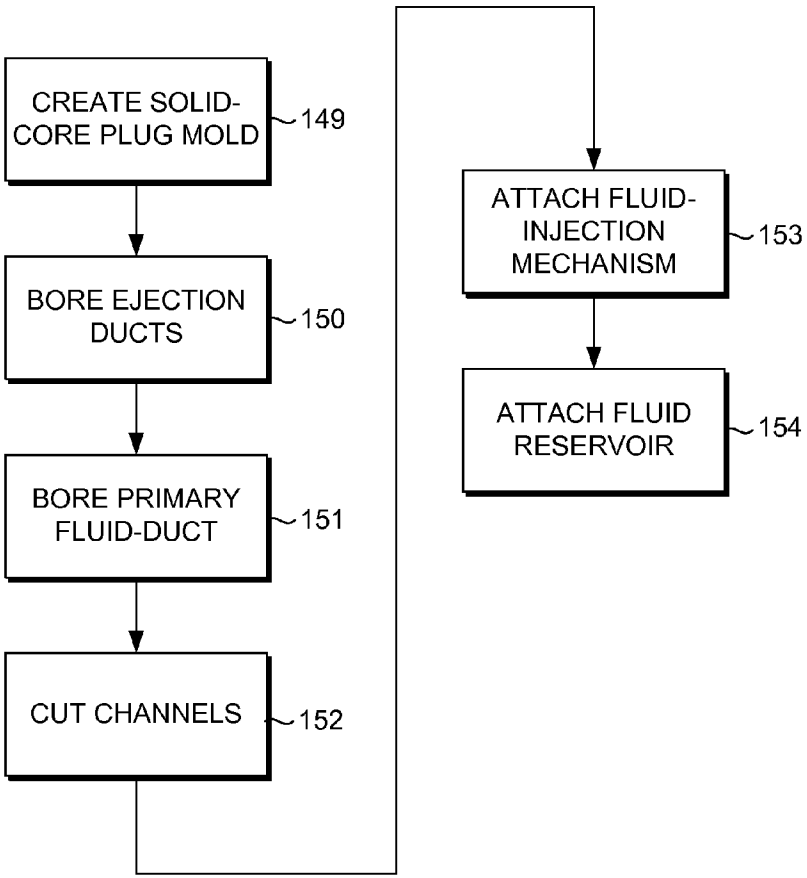
FIG. 9 is a flow chart depicting an illustrative method for constructing a device for cleaning a chamber of an electrical-connection socket in accordance with embodiments of the present invention.

Although embodiments of the device described above may be constructed using any number of processes and may be composed of any number of different materials, an illustrative example of constructing the device is depicted in the flow chart of FIG. 9. At a first illustrative step, step 149, a solid-core plug mold is created. According to various embodiments, the plug mold can be made of any number of materials. In one embodiment, for example, the mold is made of plastic. In other embodiments, the mold can be made of casting resins, silicone composites, urethane rubbers, and the like. As explained above, the solid-core mold is made to be of a similar size and shape as an electrical plug that is designed to couple with the electrical-connection socket for which the cleaning device is to be used.

At step 150, ejection ducts are bored through the mold at an angle of no greater than ninety degrees toward the tip of the mold. In embodiments, for example, each ejection duct is bored at a forty-five degree angle with respect to the length of the mold. Any number of ejection ducts can be bored. For example, in one embodiment, six ejection ducts are bored at evenly spaced positions around the circumference of the mold. In another illustrative embodiment, four ejection ducts are bored at evenly spaced positions around the circumference of the mold. The ejection ducts are bored in a widening portion of the mold, as described above, which may, for example, be approximately 20 mm from the base of the mold. The diameter of the ejection ducts can be chosen to optimize fluid-ejection performance. For instance, in one embodiment, the ejection ducts are bored with a 0.1 mm diameter.

At step 151, a primary fluid-duct is bored through the center core of the mold from the base toward the tip. The length of the primary fluid-duct may vary depending upon the size of electrical-connection socket for which the cleaning device is being constructed. For example, according to embodiments, the primary fluid-duct can be bored to approximately 23.5 mm for a 3.5 mm electrical-connection socket and to approximately 22.5 mm for a 2.5 mm electrical-connection socket. The primary fluid-duct is bored until it meets the terminal ends of the ejection ducts.

At step 152, channels are cut into the surface of the mold from the base, extending toward the ejection ports that are defined by the outside ends of the ejection ducts. In some embodiments, the channels extend to meet the ejection ducts, whereas in other embodiments, the channels do not extend to the ejection ducts, but rather terminate at some point closer to the base. For example, in one embodiment, the channels terminate at a point at which the mold body begins to taper inward. The channels can be cut with any desired width such as, for example, 0.75 mm.

At step 153, a fluid-injection mechanism is attached to the base of the mold and coupled with the primary fluid-duct. At a final illustrative step, step 154, a fluid reservoir is attached to the fluid-injection mechanism. In embodiments, the fluid reservoir and the fluid-injection mechanism can be one structure (e.g., a squeeze bulb). In other embodiments, the fluid reservoir and the fluid-injection mechanism are separate structures (e.g., a reservoir and a pump).

Many different arrangements of the various components depicted, as well as components not shown, are possible without departing from the spirit and scope of the present invention. Embodiments of the present invention have been described with the intent to be illustrative rather than restrictive. A skilled artisan may develop alternative means of implementing the aforementioned improvements without departing from the scope of the present invention.

It will be further understood that certain features and subcombinations are of utility and may be employed without reference to other features and subcombinations and are contemplated within the scope of the claims.

The invention claimed is:

1. A device for cleaning a chamber of an electrical-connection socket, the device comprising:

a plug body having a length, a first end and a second end, wherein:

said plug body having a shape of an electrical connection plug configured for coupling with the electrical connection socket; and the shape of said plug body is configured to open an electrical-connection switch of the electrical-connection socket upon the plug body being inserted into the chamber;

a primary fluid-duct that extends throughout the length of the plug body and terminates at to the second end of the plug body; and at least one of ejection duct extending away from the primary fluid-duct and terminates in an ejection port disposed on a surface of the plug body such that an angle defined between the primary fluid-duct and the ejection duct is less than ninety degrees.

2. The device of claim 1, further comprising a fluid-injection mechanism, wherein the fluid-injection mechanism causes a predetermined-portion of cleaning fluid to be forced into the primary fluid-duct.

3. The device of claim 2, wherein the fluid-injection mechanism includes a flow regulator.

4. The device of claim 1, wherein the angle defined between the primary fluid-duct and the ejection duct is forty-five degrees.

5. The device of claim 1, wherein the ejection duct is narrower in diameter than the primary fluid-duct.

6. The device of claim 1, further comprising a removable fluid-reservoir.

7. The device of claim 1, further comprising:

a fluid-injection mechanism located at to the first end of the plug body, wherein the fluid-injection mechanism causes a predetermined amount of cleaning fluid to be ejected from the ejection port.

8. The device of claim 7, wherein the fluid-injection mechanism further comprises a pump for forcing the predetermined amount of cleaning fluid into the primary fluid-duct.

9. The device of claim 7, wherein an angle defined between each of the at least one of ejection duct and the primary fluid-duct is less than ninety degrees.

10. The device of claim 9, wherein the angle defined between each of the at least one of ejection duct and the primary fluid-duct is forty-five degrees.

11. A device for cleaning a chamber of an electrical-connection socket, wherein the chamber is designed to receive an electrical plug that engages a plurality of electrical contacts within the chamber, thereby completing an electrical circuit, the device comprising:

a plug body having a length, a first end and a second end, wherein the plug body has a shape profile that is similar to a shape profile of the electrical plug;

a primary fluid-duct that extends through the length of the plug body and terminates at to the second end of the plug body;

a fluid-injection mechanism located at to the first end of the plug body, the fluid-injection mechanism configured to cause a predetermined portion of cleaning fluid to enter the primary fluid-duct; and a plurality of ejection ducts; and wherein each of the plurality of ejection ducts extends away from the primary fluid-duct and terminates, at a second end, in an ejection port disposed on an outside surface of the plug body.

12. The device of claim 11, wherein the plurality of injection ducts are evenly spaced around a circumference of a concave portion of the plug body.

13. The device of claim 12, wherein the plurality of ejection ducts includes four ejection ports.

14. The device of claim 12, wherein the plurality of ejection ducts includes six ejection ports.

15. The device of claim 11, wherein an angle defined between each of the ejection ducts and the primary fluid-duct is no greater than ninety degrees.

16. The device of claim 15, wherein the angle defined between each ejection duct and the primary fluid-duct is forty-five degrees.

17. The device of claim 11, further comprising a fluid reservoir that holds the cleaning fluid, wherein the fluid reservoir is removable such that an air reservoir can be attached, thereby enabling a flow of air to be pushed through the primary fluid-duct.

18. The device of claim 11, wherein the plug body is composed of a material including formed plastic.

* * * * *